United States Patent [19]

Rodger

[11] 4,253,635

[45] Mar. 3, 1981

[54] BULKHEAD BRACE

[76] Inventor: Kermit J. Rodger, 18003 Wentworth Ave., Lansing, Ill. 60438

[21] Appl. No.: 83,760

[22] Filed: Oct. 11, 1979

[51] Int. Cl.[3] ..... B28B 7/04

[52] U.S. Cl. ..... 249/47; 249/194; 249/219 R; 249/210; 249/159; 249/168; 425/DIG. 105

[58] Field of Search ..... 249/13, 18, 26, 27, 249/33, 48, 49, 50, 194, 219 R, 210, 158, 168, 155, 40, 47, 219 W, 159; 425/DIG. 105

[56] References Cited

U.S. PATENT DOCUMENTS

| | | | |
|---|---|---|---|
| 910,515 | 1/1909 | Drayer | 249/26 |
| 1,210,296 | 12/1916 | Fouse | 249/50 X |
| 1,222,349 | 4/1917 | Baker | 249/50 X |
| 1,694,292 | 12/1928 | Tracey | 249/27 |
| 2,017,553 | 10/1935 | Troiel | 249/194 X |
| 2,313,880 | 3/1943 | Leggett | 249/194 X |
| 2,610,660 | 9/1952 | Jennings et al. | 249/219 W X |
| 2,711,573 | 6/1955 | Bliss | 249/219 R X |
| 2,894,312 | 7/1959 | Jones et al. | 249/48 |

*Primary Examiner*—J. Howard Flint, Jr.
*Attorney, Agent, or Firm*—J. B. Dickman, III

[57] ABSTRACT

An end bracket for a wall form system is disclosed for supporting the end of a pair of spaced wall form molds. The end bracket includes a flat bar for connecting to a waler brace on one of the wall form molds and a cross bar extending from the flat bar across the end closure bulkhead form. An inclined brace extends from the flat bar to the cross bar to rigidly support the cross bar.

5 Claims, 8 Drawing Figures

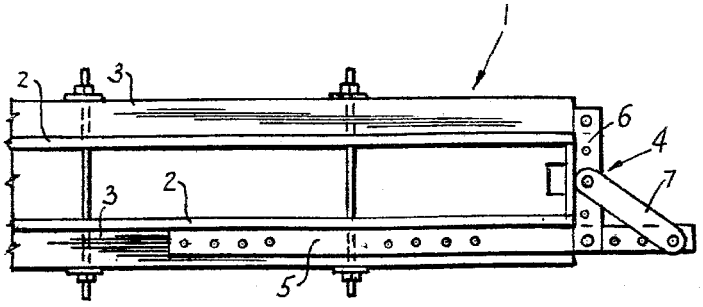
FIG. 1
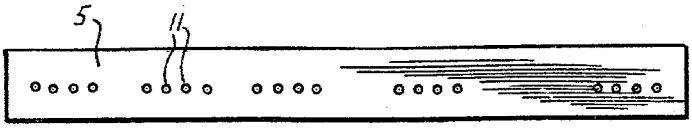
FIG. 6
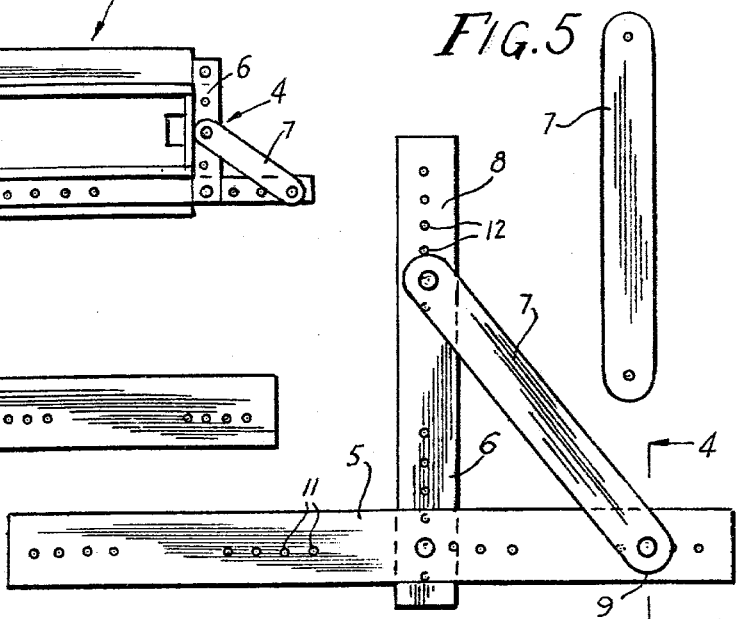
FIG. 5
FIG. 3
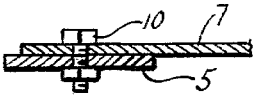
FIG. 4
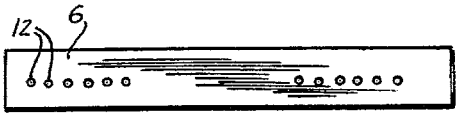
FIG. 7
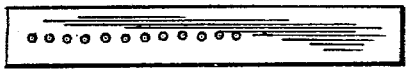
FIG. 8
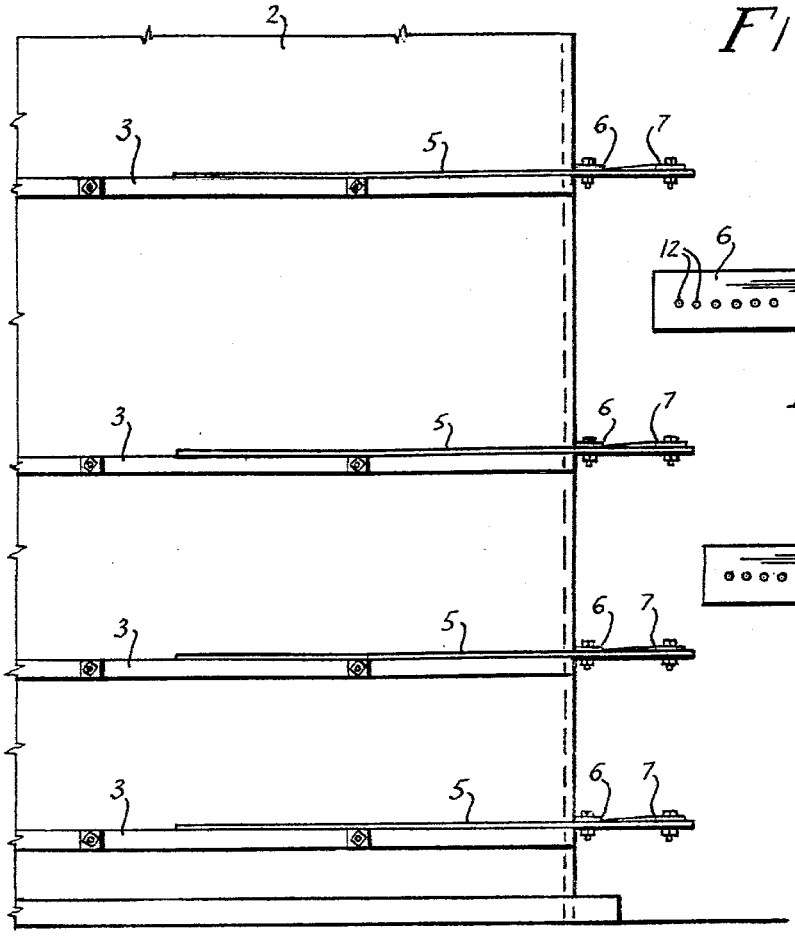
FIG. 2

BULKHEAD BRACE

BACKGROUND OF THE INVENTION

This invention relates to a bulkhead brace for connecting concrete forms and, in particular, to a bracket for connecting the ends of a wall form system.

Conventional methods for bracing and closing the ends of wall form systems have involved the use of a considerable amount of material and labor. In one of the commonly used methods an end piece made of lumber is nailed together to close the space between the two walls and a series of braces are wedged against the end piece and the ground. Each brace is installed separately by fastening it to the end piece and then, using a ground stake, wedged between the end piece and the ground. Often, four to six such braces are required to close the end of the wall form system due to the weight of the concrete poured in the mold form. A considerable amount of lumber is used to make the end piece and braces, and many manhours are spent just to close the ends of a single wall form system.

Another end piece for closing the ends of a wall form system uses tie rods and wedges of a conventional waler support for tying together two spaced walls. An end piece is positioned between the spaced walls close to the ends, and the walls are squeezed together to lock the end piece in place. While the end piece is being squeezed a wedge is forced over the tie rod, locking the walls and end piece together. This method requires a specially constructed end piece which has the proper dimensions for being squeezed without being too wide or too small. Obviously, if the end piece is too wide or too small, the spacing elements of the waler system will prevent the end piece from fitting. An end piece that is too wide will not fit between the form walls; while an end piece that is too small will be too loose and, therefore, will not seal the end of the wall form system. Considerable time is required to construct a properly fitting end piece which can be squeezed by the spaced walls.

As a result of a search of the Patent Office records, the following list of patents was developed:

U.S. Pat. No. 1,468,830;
U.S. Pat. No. 1,641,958;
U.S. Pat. No. 1,694,292;
U.S. Pat. No. 2,340,439;
U.S. Pat. No. 2,610,660;
U.S. Pat. No. 2,620,542;
U.S. Pat. No. 3,815,862

Of the above listed patents, the most interesting patents are U.S. Pat. Nos. 1,468,830 and 2,610,660. These patents are directed to forming concrete forms using wooden side walls held together by mechanical braces which extend from one end of the spaces walls and fasten to the other wall. The brace in U.S. Pat. No. 1,468,830 uses a geometric triangular support system where the hypotenus leg can be moved to collapse the brace. In U.S. Pat. No. 2,610,660 a pair of L-shaped braces are pivotally connected together to easily disassemble the wall form system. While the braces of the above patents resemble the bracket of the present invention, they neither function similarly to the bracket of the present invention, or serve the same purpose to close the end of a wall form system.

SUMMARY OF THE INVENTION

The present invention provides an end piece bracket having a rigidly braced cross bar which spans the space between a pair of spaced parallel wall forms. The cross bar mounts to a horizontal bar which fastens to a horizontal rigidifying brace on one of the wall forms. In order to rigidly brace the cross bar, an angularly disposed brace is affixed at one end to the cross bar and at the other end to the horizontal bar. The cross bar is always at a right angle to the horizontal bar and the angularly disposed brace forms the hypotenuse of a triangle where it is fixed to the cross bar and the horizontal bar. Both the cross bar and horizontal bar are provided with a plurality of adjustment holes to accommodate different width walls. There is also provided an extension bar for the cross bar for extra wide walls.

BRIEF DESCRIPTION OF THE DRAWINGS

FIG. 1 illustrates a top plan view of a wall form system showing an end bulkhead brace bracket of this invention.

FIG. 2 illustrates a side view of a wall form showing a plurality of end brackets of this invention.

FIG. 3 illustrates a top plan view of an end bracket of this invention.

FIG. 4 illustrates a partial cross sectional view taken along the line 4—4 showing an end bracket of this invention.

FIG. 5 illustrates an angularly disposed brace of an end bracket of this invention.

FIG. 6 illustrates a horizontal bar of an end bracket of this invention.

FIG. 7 illustrates a cross bar of an end bracket of this invention.

FIG. 8 illustrates an extension bar of an end bracket of this invention.

DESCRIPTION OF THE INVENTION

Referring to FIGS. 1 and 2, there is shown a wall form system 1 for forming vertical molds into which concrete is poured to form vertical walls. The wall form system 1 includes a pair of spaced parallel walls 2 which are usually made of plywood sheets having horizontally rigidifying braces 3 called waler beams. In constructing a wall form tie rods with threaded ends transverse the space between the spaced parallel walls, and are in threaded engagement with bolts on the opposite side of the wall form system. The inside of the wall forms are held in parallel spaced relationship by tapered ends of the bolt, as typified in the prior art.

An end bracket 4 of the invention is secured to one of the waler beams 3 by bolts or lag screws. The end bracket 4 includes a horizontal bar 5, a cross bar 6, and an angularly disposed brace 7, as shown in FIG. 3. The horizontal bar 5 lays flat on the top surface of a waler beam 3 as in FIGS. 1 and 2, with the cross bar 6 extending across the end closure bulkhead form. The flat bar 5 is secured to the waler beam by bolt or lag screws. To give the cross bar 6 support when concrete is poured in the cavity of the wall form and to prevent the end bulkhead from shifting an angularly disposed brace 7 is affixed near the free end 8 of the cross bar 6 and to the extended end 9 of horizontal bar 5, as shown in FIG. 3.

The cross bar 6 and angularly disposed brace 7 are bolted to horizontal bar 5 by bolts 10. FIG. 4 shows one such bolt 10 fastening angularly disposed brace 7 to horizontal bar 5. Cross bar 6 and angularly disposed bar 5 are also bolted to one another by a bolt 10.

As illustrated in FIGS. 6 and 8, the horizontal bar 5 and cross bar 6 have a plurality of aligned adjustment apertures 11 and 12, respectively. The purpose of the adjustment apertures 11 is to allow the cross bar 6 to be moved along the horizontal bar 5 to better position the cross bar against the end of a wall form system 1. The adjustment apertures 12 in cross bar 6 also allow the angle of angularly disposed brace 7 to be changed in order to provide better support to the end bracket 4.

In use, end brackets 4 are secured to the waler beams 3 as shown in FIG. 2, the cross bar 6 and angularly disposed brace 7 can then be bolted in position to back up the bulkhead. The free ends 8 of cross bars 6 are secured to the waler beams 3 of the parallel wall form 2, with an end bulkhead form in position inside the end bracket, as shown in FIG. 1.

The brace can be used not only on a two-sided wall form, but also on a single wall form, skip-wall forming and self-contained walls.

What is claimed is:

1. A wall form system for supporting the end of a concrete mold comprising;

a wall form, said wall form having a pair of parallel first and second side walls and at least one end wall, waler beams on said first and second side walls, a first means affixed to said waler beam on said first side wall for securing the first side wall, a second means secured to said first means for securing said end wall between said side walls, and a third means fastened to said first means and said second means to rigidly brace said second means.

2. A wall form system as in claim 1 wherein said second means is a cross bar having one end fastened to said first means.

3. A wall form system as in claim 2 wherein said first means is a horizontal bar secured to said waler beams on said first side wall.

4. A wall form system as in claim 3 wherein said third means is a brace fastened between said cross bar and said horizontal bar at an angle.

5. A wall form system as in claim 4 wherein said cross bar and said horizontal bar include aligned apertures for adjusting the position of said cross bar on said horizontal bar and for adjusting the angle of said brace.

* * * * *